US009878359B2

(12) United States Patent
Maeda

(10) Patent No.: US 9,878,359 B2
(45) Date of Patent: Jan. 30, 2018

(54) BENDING DEVICE FOR METALLIC PLATE

(71) Applicant: TOKYO SEIMITSU HATSUJO CO.,LTD., Kanagawa (JP)

(72) Inventor: Takaaki Maeda, Kanagawa (JP)

(73) Assignee: TOKYO SEIMITSU HATSUJO CO., LTD., Kanagawa (JP)

( * ) Notice: Subject to any disclaimer, the term of this patent is extended or adjusted under 35 U.S.C. 154(b) by 0 days.

(21) Appl. No.: 14/893,345

(22) PCT Filed: Mar. 3, 2015

(86) PCT No.: PCT/JP2015/056195
§ 371 (c)(1),
(2) Date: Nov. 23, 2015

(87) PCT Pub. No.: WO2015/151694
PCT Pub. Date: Oct. 8, 2015

(65) Prior Publication Data

US 2016/0121382 A1 May 5, 2016

(30) Foreign Application Priority Data

Mar. 31, 2014 (JP) ..... 2014-071005
Sep. 22, 2014 (JP) ..... 2014-193123

(51) Int. Cl.
*B21D 5/01* (2006.01)
*B21D 5/02* (2006.01)

(52) U.S. Cl.
CPC ..... *B21D 5/01* (2013.01); *B21D 5/0263* (2013.01); *B21D 5/0281* (2013.01)

(58) Field of Classification Search
CPC ..... B21D 5/01; B21D 5/02; B21D 5/0263; B21D 5/0281
See application file for complete search history.

(56) References Cited

U.S. PATENT DOCUMENTS 6,672,127 B2 * 1/2004 Maida ..... B21D 5/0209 72/387

FOREIGN PATENT DOCUMENTS

JP 08057541 A * 3/1996

* cited by examiner

*Primary Examiner* — Debra Sullivan
(74) *Attorney, Agent, or Firm* — Tutunjian & Bitetto, P.C.

(57) ABSTRACT

[Problem] To provide a bending device with a novel structure capable of efficiently bending a metallic plate without scratching or denting the plate.
[Solution] A device (10) for bending a metallic plate (W) mounted on a pair of movable plates (35, 35) by applying pressing force to the metallic plate by an upper die (20) along a central axis (X), wherein against the biasing force of a coil spring (45), the movable plates move with the extension of the metallic plate during bending, and therefore the metallic plate is not scratched. The upper surface of each of the movable plates is a perfect flat surface, and therefore does not dent the metallic plate being subjected to the pressing force by the upper die. When the pressing force and the load of the metallic plate are removed after the completion of bending, swing members return to the original position thereof, and the movable plates are also returned to the original position thereof by the biasing force of the coil spring, with top parts (42) of fastening members (41) coupling the movable plates to fixed plates (38) functioning as a stopper and holding the movable plates at the original position.

4 Claims, 9 Drawing Sheets

BENDING DEVICE FOR METALLIC PLATE

FIELD OF INVENTION

The present invention relates to a device used for bending metal plate such as steel, and particularly to a device of a type comprising a lower die having a pair of swingable members of substantially semi-circular cross-section and a vertically movable upper die imparting a press-push force to a metal plate placed on said swingable members at a center position between said swingable members, wherein said lower and upper dies cooperate with each other to bend said metal plate at said center position.

BACKGROUND ART

The metal plate bending device of the above-described type is known in, for example, the following Patent Documents 1-3. A metal plate to be bent is placed on the upper plates of a pair of swingable members (or plate supporting members secured thereon, the same shall apply hereinafter) at a starting position wherein the upper plates of the swingable members become flush with each other (which is a position shown in FIG. 1 of Patent Document 1, FIG. 2 of Patent Document 2 and FIG. 3 of Patent Document 3). When an upper die is moved downward to push a center position between the swingable members, the swingable members are rotated in opposite directions so that the metallic plate is bent at the center position. When compared with the device of a time-honored type using a stationary lower die (such as shown in FIG. 3 and FIG. 4 of Patent Document 1), this will provide advantages such as improved machining accuracy.

However, as the metal plate is being bent from its original flat form, its outer surface side will expand due to its material plastic deformation, resulting in out-of-position with respect to the swingable members on which the metal plate is mounted. This will cause formation of scratches on the outer surface of the metal plate and lower its commercial value.

Patent Document 4 proposes, as a solution to this problem, to use a plate supporting member slidably mounted on each of the substantially semi-circular cross-sectional swingable members. More specifically, the plate supporting member 21 is mounted onto the upper surface of the swingable member 15 in such a manner that each upper surface (the metal plate supporting surface) of the swingable member 15 is processed to form a slot 23, and a fastener 25 passing through the slot 23 is screwed to the swingable member 15, thereby allowing the plate supporting member 21 to slide and move in in-and-out directions with respect to the upper surface of the swingable member 15. In such a mounting manner, when the metal plate W supported on the plate supporting members is elongated due to its plastic deformation during the bending operation, the plate supporting member 21 will also move responsively. This will prevent scratches, which would otherwise be formed due to a position shift between the outer surface of the metal plate W and the upper surfaces of the plate supporting members 21.

PRIOR ARTS

Patent Documents

Patent Document 1: Japanese Utility-Model (un-examined) Publication No. Hei3(1991)-14010

Patent Document 2: Japanese Patent (un-examined) Publication No. 2002-001435

Patent Document 3: Japanese Patent (un-examined) Publication No. 2002-120016

Patent Document 2: Japanese Patent (un-examined) Publication No. Hei10(1998)-166060

SUMMARY OF INVENTION

Problems to be Solved by Invention

Although, as described above, the arrangement disclosed in Patent Document 4 is effective in order to prevent the scratches from being formed on the metal plate, the inventor's investigation has revealed that there still remains a problem to be solved.

This is undesirable formation of press-mark on the outer surface of the metal plate, which results from the slot 23 formed in the plate supporting member 21. More specifically, in accordance with the solution of Patent Document 4, the plate supporting member 21 is secured to the swingable member 15 by means of the fastener 25 passing through the slot 23 formed in the upper surface of the plate supporting member 21, to thereby allow the plate supporting members 21 to move along with the metal plate W, when the metallic plate W is elongated due to its plastic deformation during the bending operation. This will make it possible to prevent scratches from being formed due to relative displacement between the metal plate W and the plate supporting member 21. On the other hand, while the metal plate W is being pressed by the upper die 7, the outer surface of the metal plate W will become into contact under a greater pressure with the upper surface of the plate supporting member 21, which would damage the outer surface of the metal plate W to form thereon a press-mark having a contour corresponding to the slot 23.

Accordingly, a problem to be solved by the present invention is to provide a metal plate bending device with novel structure capable of efficiently bending a metal plate without scratching or denting the metallic plate. Another problem to be solved by the present invention is to prevent any damages from being formed on the metal plate, which would be caused by joints between the adjacent bending devices, when plural bending devices are connected in a lengthwise direction so as to bend a long-length metal plate.

Means for Solving the Problems

To solve these problems, in one embodiment of the present invention, there is provided a metal plate bending device comprising a lower die having a main body with a pair of semi-circular cross-sectional recesses formed on an upper surface thereof in a symmetric design with respect to a center line and a pair of swingable members swingably received in said recesses respectively, and an upper die arranged above said lower die movably along the center line, wherein said upper die is moved toward a metal plate mounted on said lower die to impart a press-push force to the metal plate to thereby cause the swingable members to swing and at the same time bend the metal plate along the center line, characterized in that each of said swingable member has a movable plate unfixedly mounted on an upper surface of said swingable member, and spring means for providing a biasing force to move said movable plate in a mutually separating direction, said spring means still allowing said movable plate to move in a mutually approaching direction toward said swingable member against said biasing force along with expansion of the metal plate during the bending operation, said movable plates providing a completely flat metal plate supporting surface, and said spring means being positioned externally to provide no interfere with said flat metal plate supporting surface.

According to one embodiment of the present invention, in a metal plate bending device, it is characterized in that a spring means comprises coil spring or leaf spring.

According to one embodiment of the present invention, in a metal plate bending device, it is characterized in that movable plates are directly or indirectly secured by fasteners to swingable members in the outside of swingable members, heads of fasteners positioned externally of said movable plates acting as stopper means for maintaining said swingable members to stay in their starting position.

According to one embodiment of the present invention, in a metal plate bending device, it is characterized in that spring members comprising coil springs surrounding shafts of fasteners.

According to one embodiment of the present invention, in a metal plate bending device, it is characterized in that movable plates are mounted detachably.

According to one embodiment of the present invention, in a metal plate bending device, wherein a plurality of the metal plate bending devices are connected in series in a lengthwise direction for bending a metal plate longer than a length of a single metal plate bending device, it is characterized in that movable plates are long-length movable plates equal to or longer than the long-length metal plate, which are mounted successively over said plural metal plate bending devices.

Advantages of Invention

In accordance with the present invention, the metal plate supported on the movable plates which, in turn, are slidably mounted on the swingable members of the lower die, is subjected to the bending operation, while swinging the swingable members, which will prevent formation of scratches on the metal plate. In addition, the movable plates provide a completely flat metal plate supporting surface with no hole and opening, which will prevent formation of press-mark on the metal plate. Accordingly, the metal plate may be bent with a completely undamaged surface, which will not lower its commercial value.

Further, the movable plates are biased by the spring members in such a manner that, when the metal plate expands due to its plastic deformation during the bending operation, the movable plates will move, against the biasing force, relative to the swingable members along with expansion of the metal plate, whereas, once the metal plate is removed from the lower die after the bending operation, the movable plates (and the swingable members) will soon be returned to their starting positions to become ready for the next bending operation, thanks to restoration of the spring members. The stopper means will work to more precisely return the movable plates to the starting positions and keep them thereat.

In accordance with an embodiment wherein the movable plates are mounted detachably, in a case wherein a plurality of the metal plate bending devices are connected in series in a lengthwise direction for bending a metal plate longer than a length of a single metal plate bending device, long-length movable plates may be used and mounted successively over the plural metal plate bending devices. This will prevent formation of any damages on the metal plate, which could otherwise be formed by joints between the adjacent bending devices. This will also be advantageous in respect of cost, because it is possible to replace the movable plate 35 only, when the movable plate should have been damaged by, for example, abrasion by relative movement to the metal plate W after repeated use for bending operation.

The metal plate bending device according to the present invention may be provided as a retrofit unit having some necessary parts to be fitted to an existing device or as a new complete device having all necessary parts.

BRIEF DESCRIPTION OF DRAWINGS

In FIG. 8, as a matter of convenience, Embodiment 5 is shown in left of the center axis, and Embodiment 6 is shown in right.

In FIG. 9, as a matter of convenience, Embodiment 7 is shown in left of the center axis, and Embodiment 8 is shown in right.

EMBODIMENTS OF INVENTION

The present invention will be described in detail in reference to some embodiments thereof.

Embodiment 1

Figure 1:
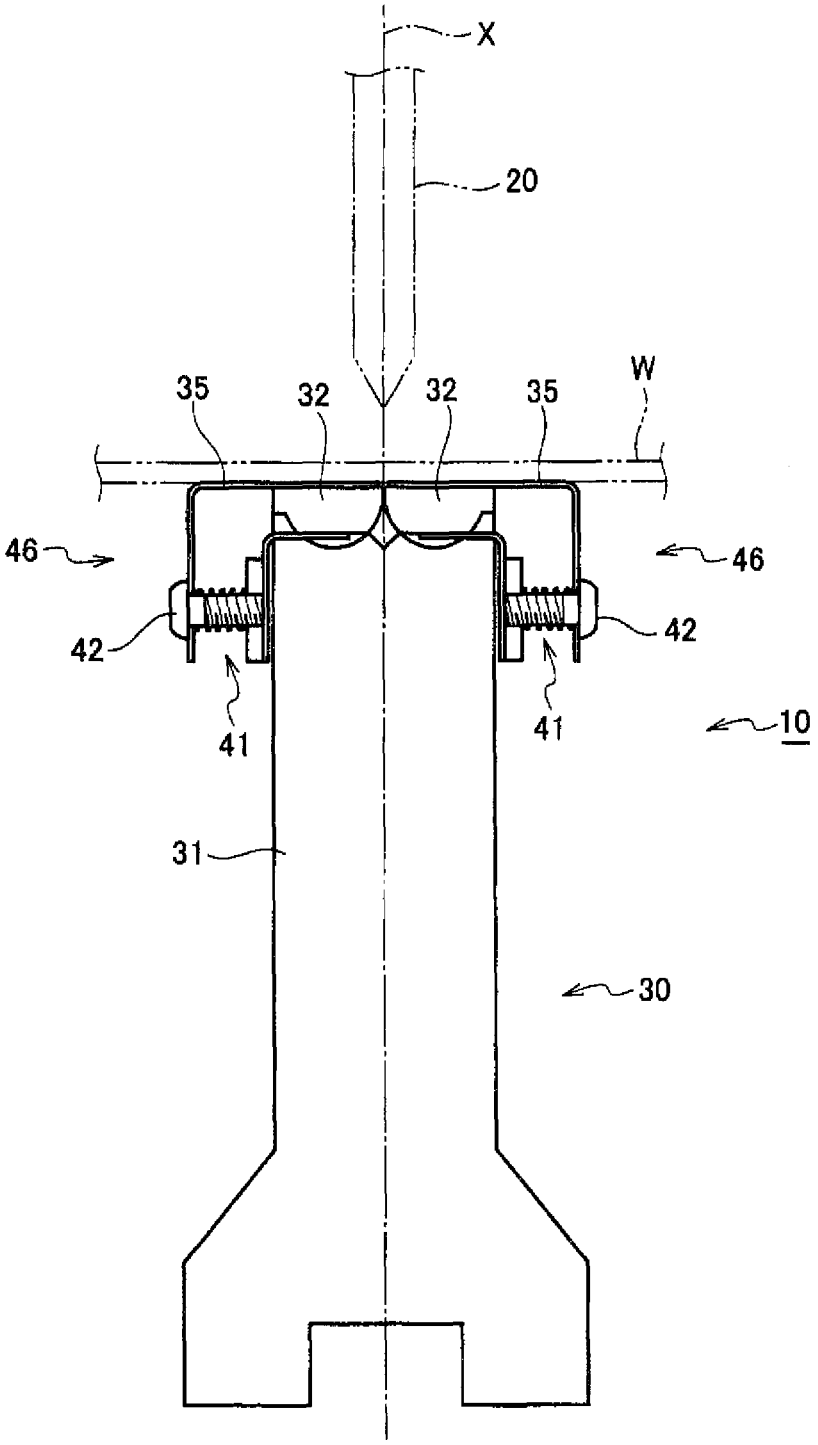
FIG. 1 is a front view showing an outline of a metal plate bending device according to one embodiment (Embodiment 1) of the present invention.
Figure 2:
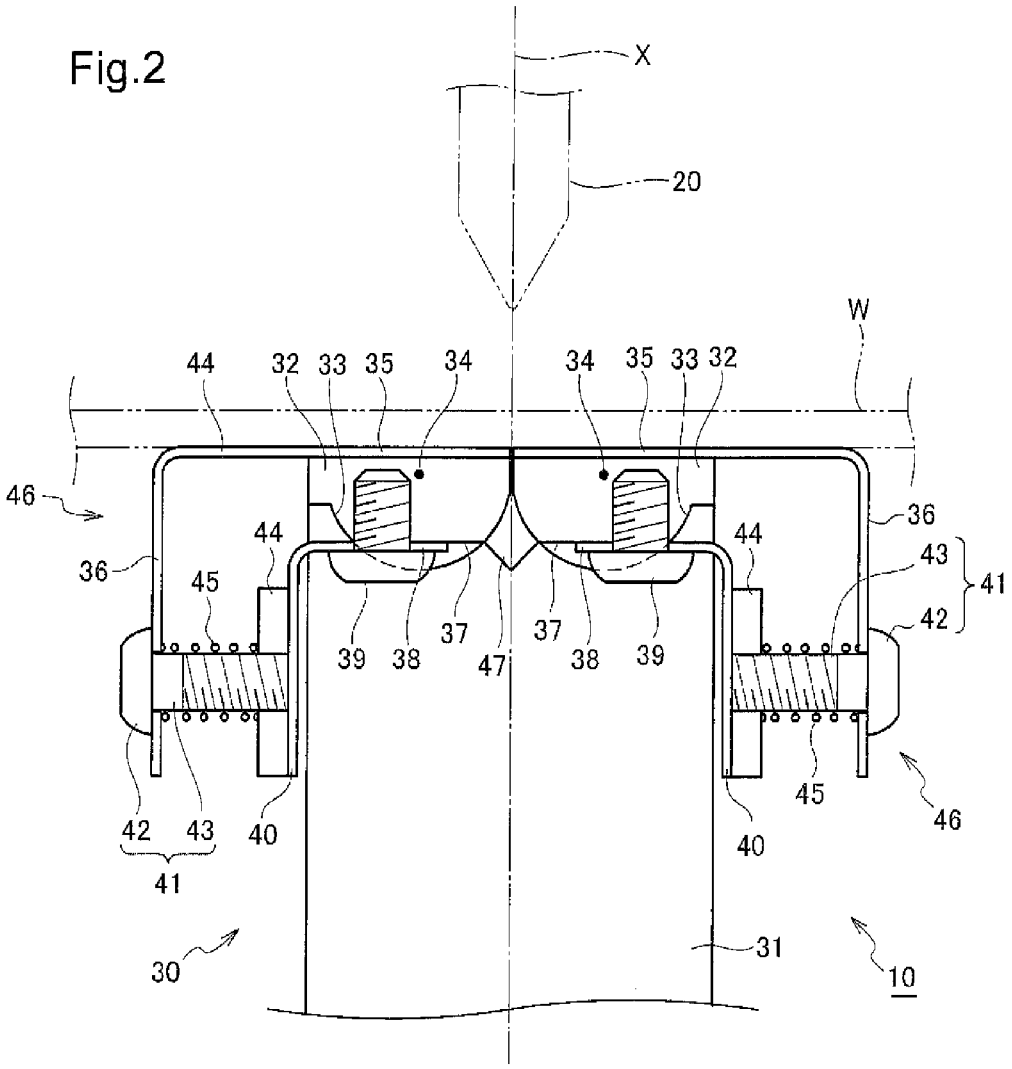
FIG. 2 is an enlarged front view showing a principal part of this device in a standby condition.
Figure 3:
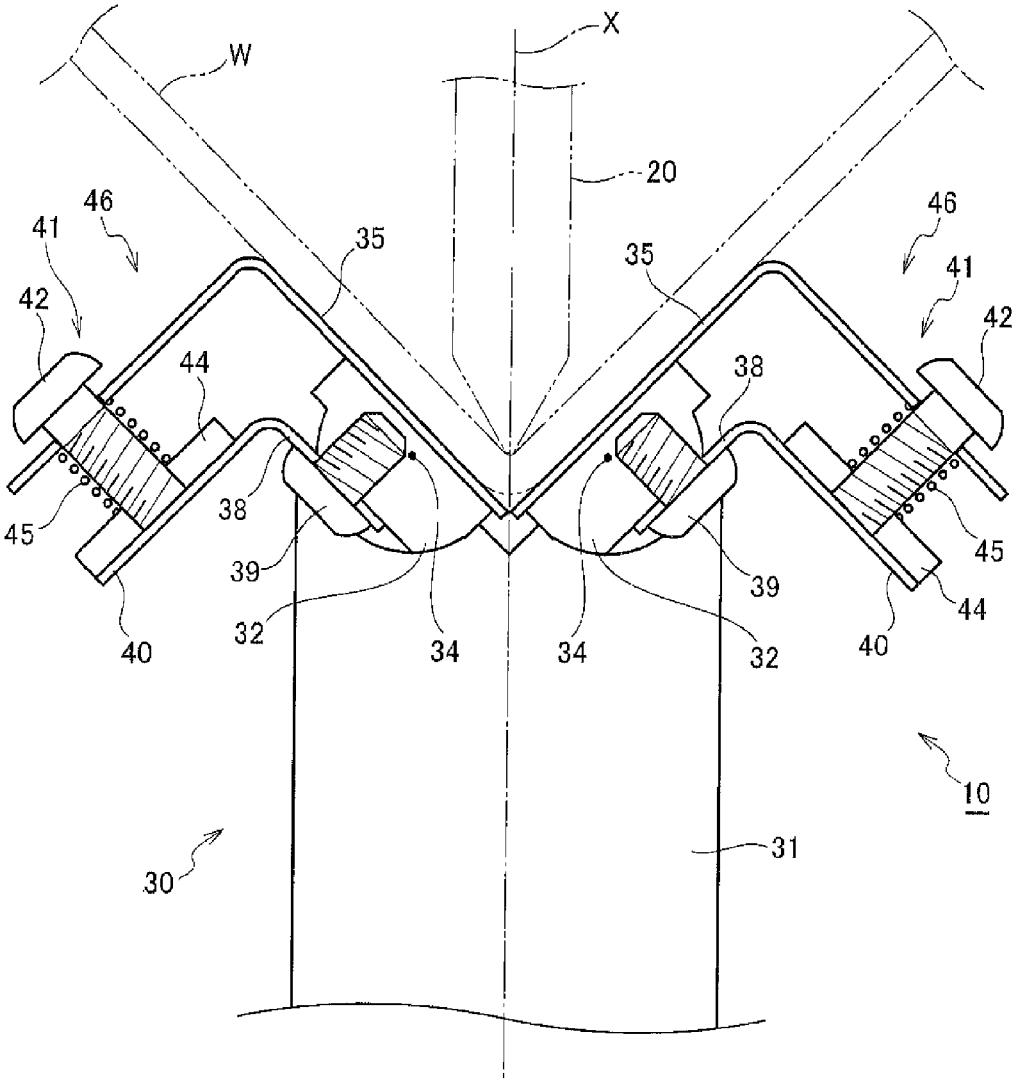
FIG. 3 is an enlarged front view showing the principal part of this device that is used in the bending operation.

FIG. 1 to FIG. 3 show a metal plate bending device 1 according to one embodiment (Embodiment 1) of the present invention. Among them, FIG. 1 is a front view showing an outline of the device 10, FIG. 2 is an enlarged front view showing a principal part of the device 10 that is in a standby condition or a starting position, and FIG. 3 is an enlarged front view showing the principal part of the device 10 that is being used for bending a metal plate W.

This device 10 comprises an upper die 20 and a lower die 30 including a main body 31 and a pair of swingable members 32, 32. The upper die 20 is positioned above the lower die 30 and is movable (elevatable) along a center axis X of the main body 31. In its standby condition (FIG. 2), It stands at a position (starting position) remote above from the lower die 30, which is driven by a drive mechanism (not shown) to move downward from the starting position, to thereby subjecting a metal plate W to the bending operation (FIG. 3). After the bending operation is completed, it is again driven by the drive mechanism to be returned to the starting position.

The upper surface of the lower die main body 31 has a pair of recesses 33, 33 in a symmetric manner with respect to the center line X. Each recess 33 has substantially a semi-circular cross-section with respect to its center axis, so that, when the swingable member 32 having substantially a semi-circular cross-section that corresponds to the inner wall shape of the recess 33 is received within the recess, the swingable member 32 is allowed to swing in both directions about its axis of rotation 34. The swingable members 32, 32 are normally biased by springs, not shown, toward the standby condition (FIG. 2), but may be moved in mutually reverse directions to the condition of FIG. 3 against the biasing force by the spring, when the press-push force by the upper die 20 is imparted along the center axis X. The upper surface of the lower die main body 31 has a V-shaped groove 47 between the recesses 33, 33 (along the center axis X).

A movable plate 35 is mounted unfixedly on each of the swingable member 32. In the standby condition (FIG. 2), the movable plates 35, 35 provide a coplanar metal plate supporting surface, wherein their leading ends are substantially in contact with each other or there is a small gap therebetween, in the starting position. Each movable plate 35 extends outwardly from the swingable member 32 over a predetermined length and then is folded downwardly to form a hang-down piece 36. The upper surface of the movable plate 35 (a metal plate supporting surface 44) is formed as a completely flat surface. A friction between the movable plate 35 and the metal plate W is designed to be greater than a friction between the swingable member 32 and the movable plate 35. This may be achieved by any suitable solution, as required, including coating of low-frictional material on the upper surface of the swingable member 32 and/or the lower surface of the movable plate.

The lower portion of each swingable member 32 having substantially a semi-circular cross-section is partly cut out to form a step 37, and the swingable member 32 is secured, by a fastener such as a bolt 39, to a stationary plate 38 placed in contact with the step 37. The stationary plate 38 extends to the outside of the main body 31 and then is folded downwardly to a hang-down piece 40. In the standby condition (FIG. 2), the hang-down piece 40 is substantially in contact with the outer surface of the main body 31 or there is a small gap therebetween.

As such, each swingable member 32 is secured to the stationary plate 38 by the bolt 39 in a manner that it is interposed from above and below between the movable plate 35 and the stationary plate 38. On the contrary, the movable plate 35 is not fixed to the swingable member 32 but simply placed thereon, so that the movable plate 35 is slidable with respect to the swingable member 32 along the contact surface therebetween.

The hang-down piece 36 of the movable plate 35 and the hang-down piece 40 of the stationary plate 38 extend substantially in parallel with each other with a space therebetween, in a region outside of the lower die main body 31, and their lower end portions are connected to each other by a fastener such as a bolt 41. A head 42 of the fastener 41 is positioned externally of the hang-down piece 36, and its shaft 43 extends through a hole (not shown) formed in the hang-down piece 36 to be fixedly connected to an attachment 44 that is secured by welding, for example, to the outside of the hang-down piece 40. A coil spring 45 surrounding the shaft 42 of the fastener 41 provides a biasing force for usually pushing the movable plate 35 apart from the stationary plate 38, and the head 42 of the fastener 41 will act as a stopper so as to maintain a predetermined distance therebetween. When the metal plate W expands due to its plastic deformation during the bending operation to be described later, the movable plate 35 will be moved along with expansion of the metal plate W in a direction approaching to the stationary plate 38, against the biasing force by the coil spring 45.

The movement and operation of this device 10 to be used to bend a metal plate W will now be described. At first, a metal plate W to be bent is placed on a pair of movable plates 35, 35 which provide a coplanar, horizontal metal plate supporting surface 44 in the standby condition (FIG. 2). At this time, the metal plate W is placed in such a manner that a bending position of the metal plate W is just aligned with the center axis X.

From this condition, the upper die 20 waiting at the starting position remote above from the lower die 30 is driven to move downwardly, so that its leading end becomes into contact with the bending line of the metal plate W that is just aligned with the center axis X. Further descent will cause the swingable members 32, 32 to rotate in opposite directions about the axes of rotation 34, 34, so that the assemblies 46, 46 each having the movable plate 35, the stationary plate 38, the fastener 41 and the coil spring 45, etc. will also swing in the same directions together with the swingable members 32, 32. FIG. 3 shows that the metal plate W has been bent at an angle of 90 degrees.

As having been described in conjunction with the prior art, when the metal plate W is subjected to the bending operation, it will expand due to its plastic deformation. However, in accordance with the device 10 wherein the movable plates 35, 35 are arranged movably in the directions approaching to the stationary plates 39 against the biasing forces by the coil springs 45. Accordingly, when the metal plate W expands, the movable plates 35, 35 will responsively be moved in mutually approaching directions. The leading ends of the movable plates 35, 35 are positioned substantially in alignment with each other at the inner edges of the upper surfaces of the swingable members 32, 32 in the standby condition (FIG. 2), whereas, when the bending operation has proceeded (as shown in FIG. 3), the leading ends of the movable plates 35, 35 protrude from the inner edges of the upper surfaces of the swingable members 32, 32 to get into the V-shaped groove 47, by which it may be understood that the movable plates 35, 35 have moved or slid relative to the swingable members 32, 32 in response to expansion of the metal plate W. The sliding movement of the movable plate 35, 45 is achieved by compression of the coil spring 45 against its basing force and movement of the movable plate hang-down piece 35 toward the stationary plate hang-down piece 40.

Consequently, in accordance with the device 10, when the metal plate W expands due to the plastic deformation during the bending operation, the movable plates 35, 35 supporting the metal plate will also move along with expansion of the metal plate W, so that there is no relative movement therebetween and no scratches should be formed on the metal plate W.

Moreover, the upper surfaces of the movable plates 35, 35 that provide the metal plate supporting surface 44 are absolutely flat and perfect with no hole and opening. Accordingly, even when subjected to the pushing force imparted by the upper die 20, no press-mark should be formed on the metal plate W (unlike with the device of Patent Document 4, as described before).

After the bending operation has been carried out in such manner, the upper die 20 is elevated and returned to the starting position (FIG. 2), the processed metal plate W is removed from the lower die 30. With the push-press force by the upper die 20 and the own weight of the metal plate W being released, the biasing force by the not-shown spring will cause the swingable members 32, 32 to rotate in directions reverse to the above-described directions, and the biasing force by the coil springs 45, 45 will cause the movable plates 35, 35 to move away from the stationary plate hang-down pieces 40, 40. As such, the device will be automatically returned to the standby condition of FIG. 2. As having been described, the position of the movable plates 35, 35 in the standby condition will be defined by the stopper function of the heads 42, 42 of the fasteners 41, 41, so that they may always be restored to the starting position of FIG. 2 without fail and become ready for the next meal plate bending operation.

The fastener 41 will connect the movable plate 35 to the stationary plate 38 and its head 42 will provide the stopper function, whereas the coil spring 45 will force the movable plate 35 toward the starting position and also allow the same to be moved relative to the swingable member 32 and the stationary plate 38 during the bending operation. As such, they have different functions and therefore may be arranged at different positions. However, as in the device 10, when the coil spring 45 is arranged to surround the shaft 43 of the fastener 41, the coil spring 45 can work stably, so this is a preferred embodiment.

The lower die 30 of the device 10 may be fabricated by adding the assemblies 46 to the existing lower die 30 including the main body 31 and the swingable members 32, 32. Accordingly, this embodiment may also be preferably used as a retrofit-type unit.

Embodiment 2

Figure 4:
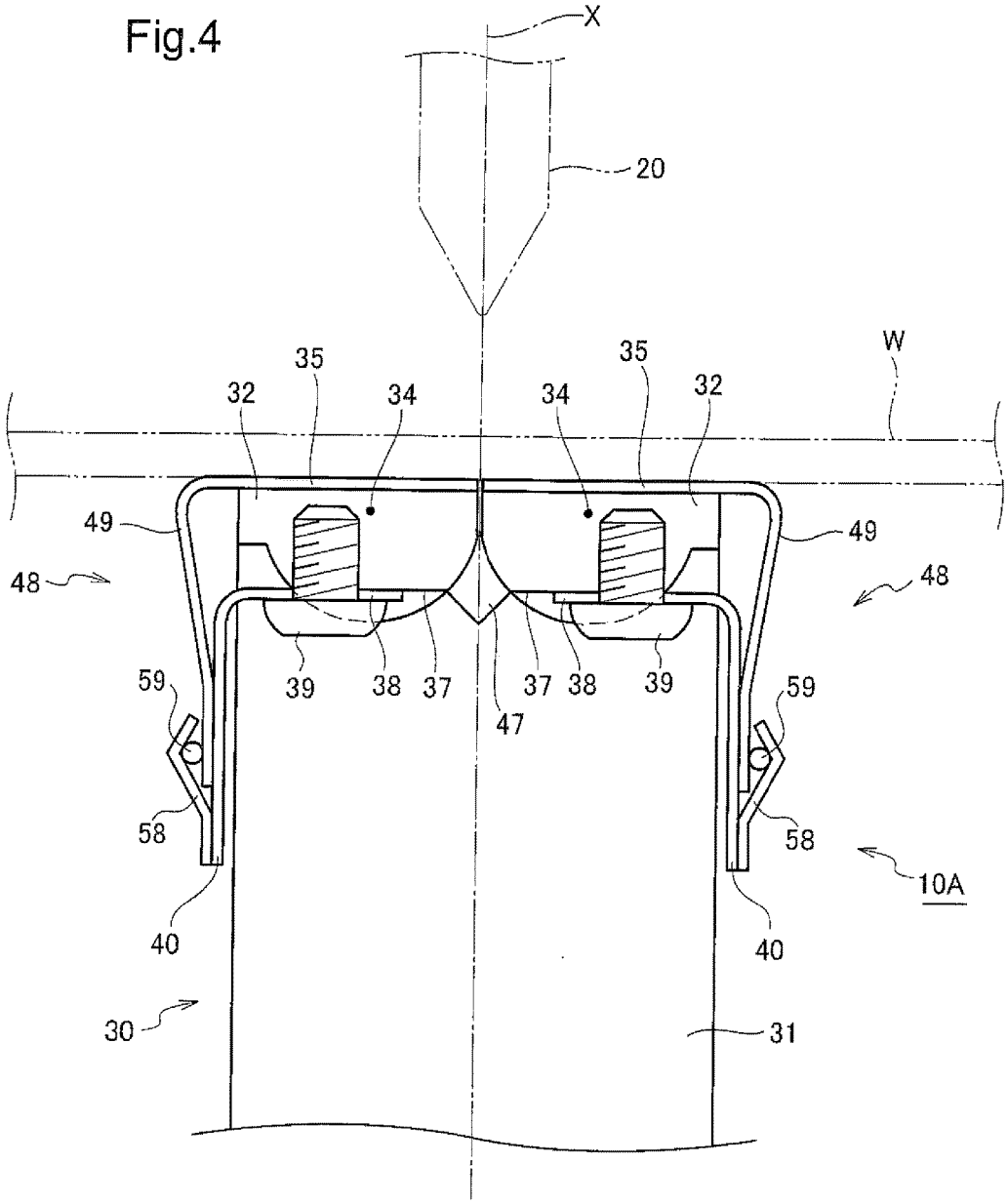
FIG. 4 is an enlarged front view showing a principal part of a metal plate bending device according to another embodiment (Embodiment 2) of the present invention in a standby condition.
Figure 5:
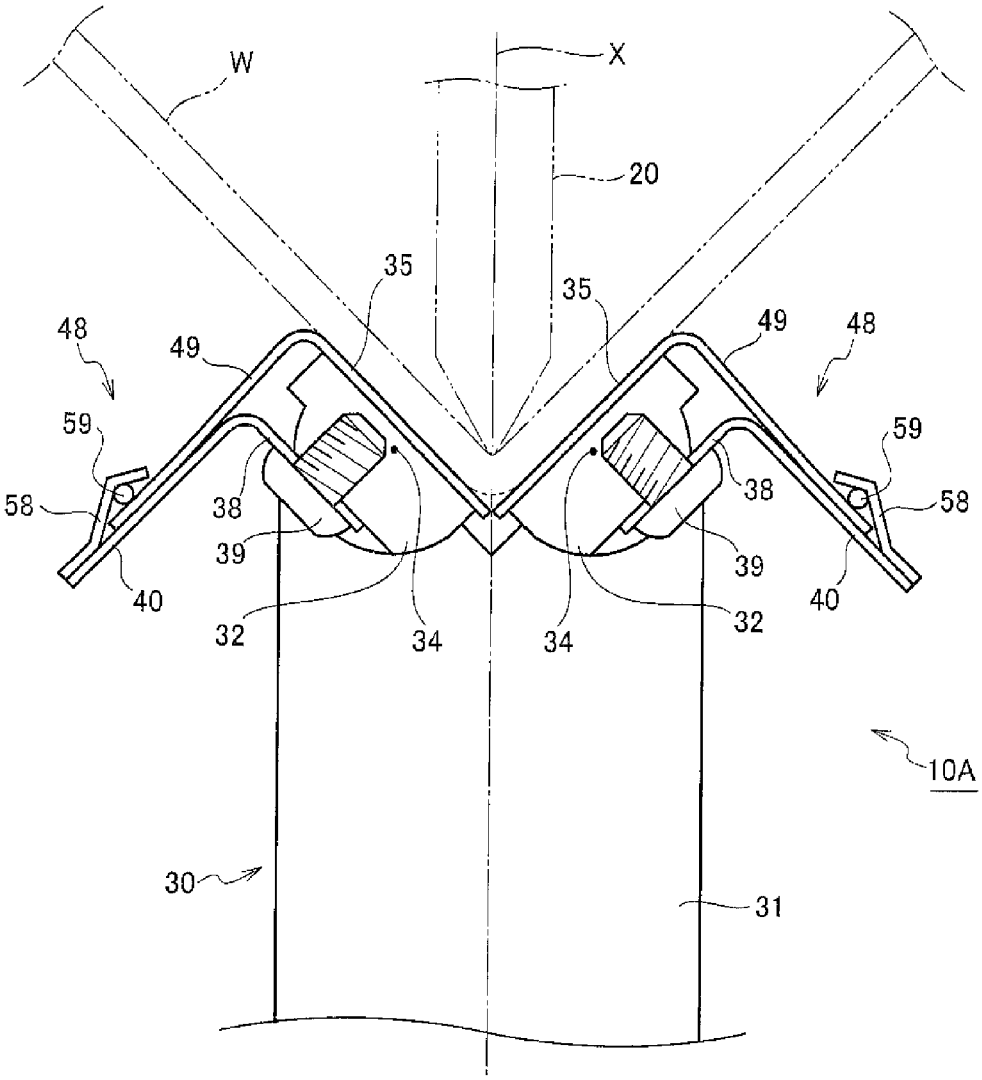
FIG. 5 is an enlarged front view showing the principal part of this device that is used in the bending operation.

FIG. 4 and FIG. 5 show a metal plate bending device 10A according to another embodiment (Embodiment 2) of the present invention. Among them, FIG. 4 is an enlarged front view showing a principal part of the device 10A in a standby condition or starting position, and FIG. 5 is an enlarged front view showing the principal part of the device 10A that is being used to bend a metal plate W. The structure of the device 10A has many points in common with the device 10 according to Embodiment 1, so that these common parts or elements are shown with identical symbols and their explanation will be omitted. The device 10A will be described hereinbelow with regard to differences from the device 10.

The device 10A is different from the device 10 according to Embodiment 1 in structure of a retrofitable unit or assembly. More specifically, each assembly 48 of the device 10A has a stationary plate 38 fixed by a fastener 39 to a swingable member 32 in contact with a lower step 37 of the swingable member 32, which is similar to the stationary plate 38 in the assembly 46 of the device 10 of Embodiment 1. However, with regard to a movable plate 35 slidably mounted on the upper surface of the swingable member 32, it extends outwardly in a small distance from a lower die main body 31 and the swingable member 32 and then is folded downwardly at an acute angle, and its leading end is connected to a hang-down piece 40 of the stationary plate 38, so that a part of a downward flap 49 will act as a leaf spring. In more detail, a folded plate 58 is superposed on the outside of the hang-down piece 40 of the stationary plate 38, and the leading end of the downward flap 49 of the movable plate 35 is inserted into a gap between a round bar 59, arranged inside of a folded portion of the folded plate, and the hang-down piece 40.

The downward flap 49 corresponds to the coil spring 45 in the device 10 of Embodiment 1 and will act substantially in the same manner. More specifically, when using the device 10A for bending the metal plate W, the metal plate W to be bent is placed on a horizontal metal plate supporting surface 44 that is defined by a pair of movable plates 35, 35 oriented coplanar in the standby condition (FIG. 4), and the upper die 20 is driven to move down from the starting position (FIG. 4), so that a pair of swingable members 32, 32 are driven to rotate in opposite directions to perform the bending operation. FIG. 5 shows that the metal plate W has been bent at an angle of 90 degrees.

During such operation, the assemblies 48, 48 also swing together with the swingable members 32, 32, and the assemblies 48, 48 having the downward flap 49,
49 will act by themselves as leaf springs. Therefore, when the metal plate W expands during the bending operation, the movable plates 35, 35 will be moved responsively in mutually approaching directions. The leading ends of the movable plates 35, 35 are positioned substantially in alignment with each other at the inner edges of the upper surfaces of the swingable members 32, 32 in the standby condition (FIG. 4), whereas, when the bending operation has proceeded (as shown in FIG. 5), the leading ends of the movable plates 35, 35 protrude from the inner edges of the upper surfaces of the swingable members 32, 32 to get into the V-shaped groove 47, by which it may be understood that the movable plates 35, 35 have been moved or slid relative to the swingable members 32, 32 in response to expansion of the metal plate W. With the device 10A, the downward flaps 49, 49 will provide biasing force toward the standby condition, similar to the coil spring 45 in the device 10 of Embodiment 1, and when the metal plate W expands during the bending operation, the leaf spring action by the downward flaps 49, 49 will cause the movable plates 35, 35 to be moved in mutually approaching directions, against the biasing force, and slid relative to the lower die main body 31 and the swingable members 32, 32.

Accordingly, when the device 10A is used to bend the metal plate W, as in the preceding embodiment, there is no relative movement between the movable plates 35, 35 and the metal plate W supported thereon, so that no scratches should be formed on the metal plate W.

Moreover, the upper surfaces of the movable plates 35, 35 that form the metal plate supporting surface 44 are absolutely flat and perfect with no hole and opening. Accordingly, even when subjected to the press-push force imparted by the upper die 20, no press-mark should be formed on the metal plate W.

After the bending operation has been carried out in these manners, the upper die 20 is elevated and returned to the starting position (FIG. 4), the bent metal plate W is removed from the lower die 30. With the press force by the upper die 20 and the load of the metal plate W being released, the biasing force by the not-shown spring will cause the swingable members 32, 32 to rotate in directions reverse to those described before, and the leaf spring action by the downward flaps 49, 49 will cause the movable plates 35, 35 to become their original shapes As such, it will be automatically returned to the standby condition of FIG. 4. The fasteners 41, 41 in the device 10 of Embodiment 1 are omitted in the device 10A and, therefore, there is no stopper action to be achieved by the fastener heads 42, 42. However, the downward flaps 49, 49 act as the leaf springs and have restoring forces toward their original shapes, which makes it possible to restore the device to the standby condition of FIG. 4 with good accuracy, so that the device may be ready for the next bending operation. If necessary, it may be so designed that, for example, fasteners similar to the fasteners 41, 41 in the device 10 of Embodiment 1 are arranged between the downward flaps 49, 49 and the stationary plate hang-down pieces 40, 40, so that the fastener heads 42, 42 provide the stopper action.

The lower die 30 of the device 10 may be fabricated by adding the assemblies 48 to the existing lower die 30 including the main body 31 and the swingable members 32, 32. Accordingly, this embodiment may also be preferably used as a retrofit-type unit.

Embodiment 3

Figure 6:
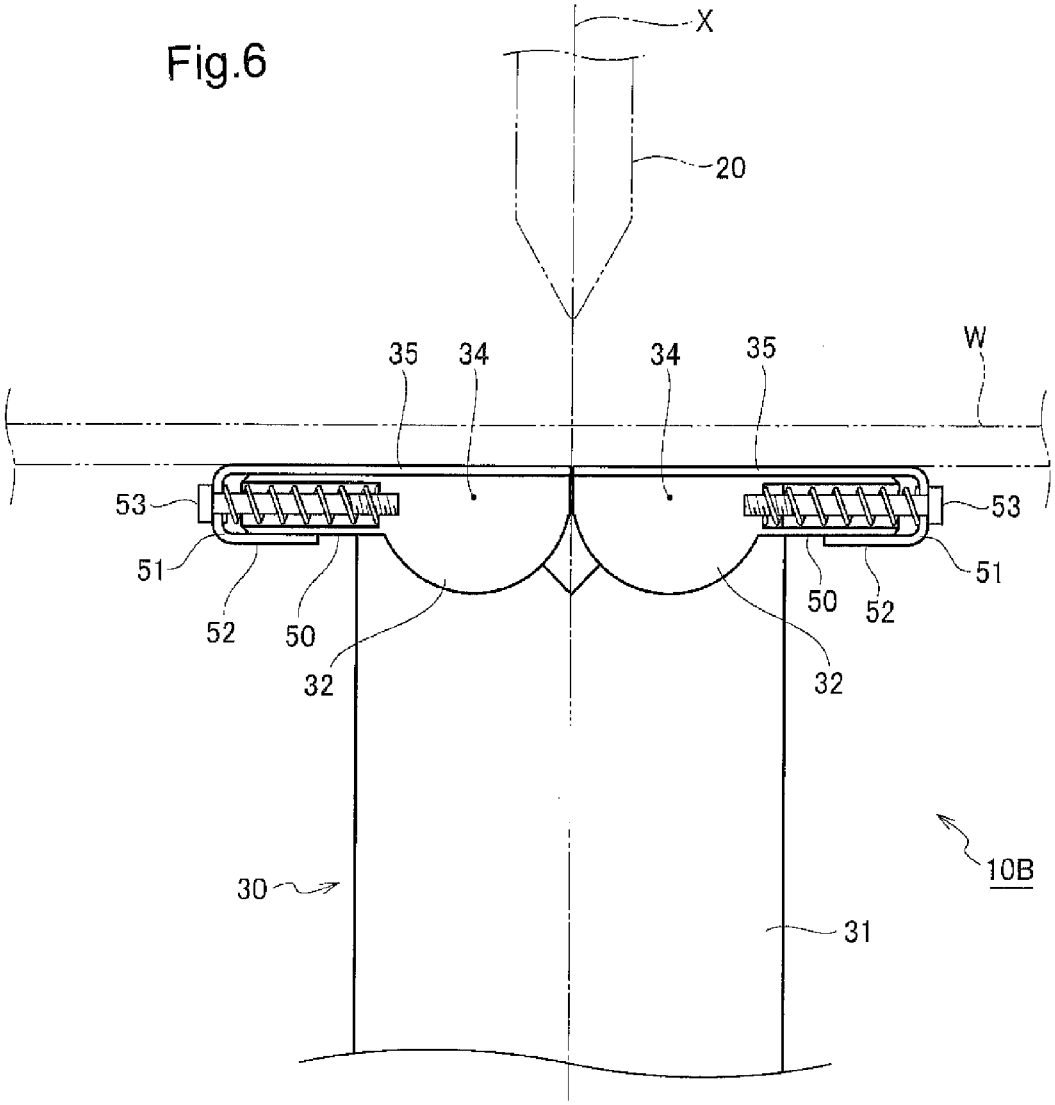
FIG. 6 is an enlarged front view showing a principal part of a metal plate bending device according to still another embodiment (Embodiment 3) of the present invention in a standby condition.

FIG. 6 is an enlarged front view showing a principal part of a metal plate bending device 10B according to still another embodiment (Embodiment 3) of the present invention in a standby condition or starting position. The structure of the device 10B has many points in common with the device 10 according to Embodiment 1, so that these common parts or elements are shown with identical symbols and their explanation will be omitted, and the features of the device 10B that are different from the device 10A will be described. The structure of the device 10B is preferably used as a new complete device having all necessary parts, which provides substantially the same function as that achieved by the assemblies 46, 46 in the device 10 of Embodiment 1.

A detailed explanation will be given in reference to FIG. 6. Each swingable member 32 in the device 10B has an outwardly, horizontally extending cylinder 50. A movable plane 35 extends outwardly from the swingable member 32 over a predetermined length and then is folded downwardly to form a hang-down piece 51 and then is again folded to form a lower horizontal piece 52, which surround the cylinder 50. The substantially U- or J-shaped movable plate 35 including the hang-down piece 51 and the lower horizontal piece 52 is fixed to the swingable member 32 by a fastener 53 such as a bolt extending through the hang-down piece 51 and the cylinder 50, which is usually biases to be moved apart from the swingable member 32 by a coil spring 51 coiled around the fastener 53, so that the head of the fastener 53 remains in contact with the outer surface of the hang-down piece 51 (FIG. 6). Accordingly, during the bending operation, the movable plates 35, 35 will be moved in mutually approaching directions along with expansion of the metal plate W, against the biasing force, whereas they will automatically be returned to their standby condition of FIG. 6 and stay in said condition by the biasing force, when the bending operation is completed.

Embodiment 4

Figure 7:
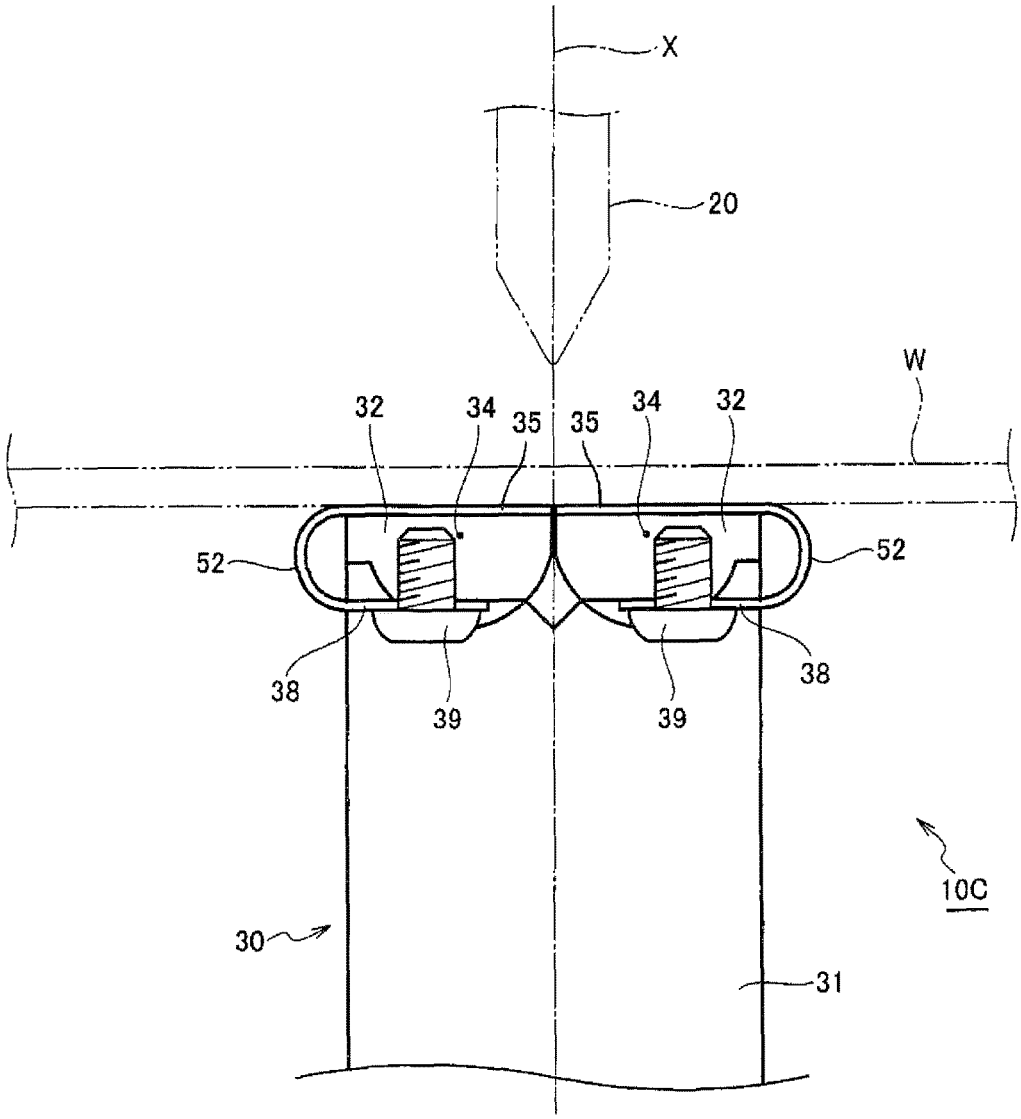
FIG. 7 is an enlarged front view showing a principal part of a metal plate bending device according to still another embodiment (Embodiment 4) of the present invention in a standby condition.

FIG. 7 is an enlarged front view showing a principal part of a metal plate bending device 10C according to still another embodiment (Embodiment 4) of the present invention in a standby condition or starting position. The structure of the device 10C has many points in common with the device 10A according to Embodiment 2, so that these common parts or elements are shown with identical symbols and their explanation will be omitted, and the features of the device 10C that are different from the device 10A will be described.

A detailed explanation will be given in reference to FIG. 7. In the device 10C, each movable plate 35 is formed integrally with a stationary plate 38, via a round portion 55 rounded outwardly of a swingable member 32, which will form a U-shaped leaf spring as a whole. With such arrangement, the movable plates 35, 35 will likewise be moved in mutually approaching directions along with expansion of the metal plate W, against the biasing force, during the bending operation, whereas they will automatically be returned to their standby condition of FIG. 7 and stay in said condition by the biasing force, when the bending operation is completed.

The lower die 30 of the device 10C may be fabricated by adding the leaf springs 52 formed integrally with the movable plates 35, 35 to the existing lower die 30 including the main body 31 and the swingable members 32, 32. Accordingly, this embodiment may also be preferable as a retrofit-type unit.

Embodiment 5

Figure 8:
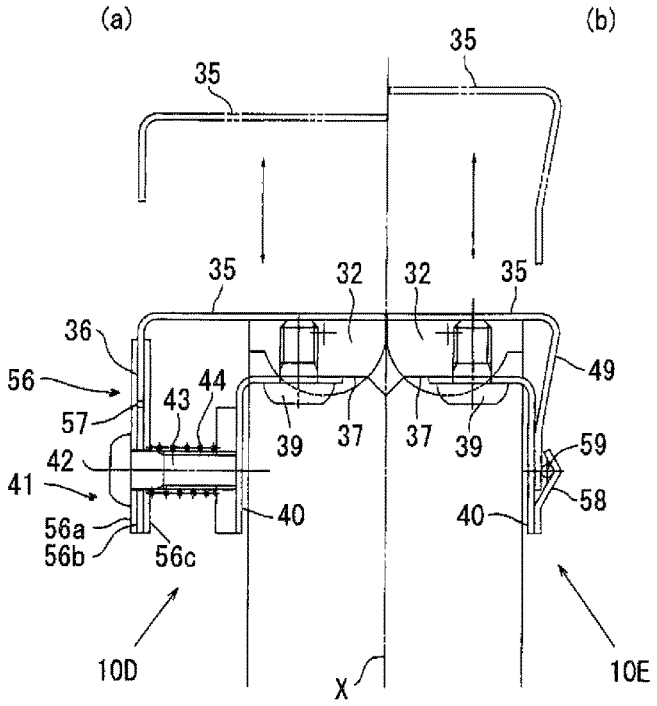
FIG. 8 comprises (a) an enlarged front view showing a principal part of a metal plate bending device according to a modified embodiment (Embodiment 5) in a standby condition, wherein the movable plates in Embodiment 1 are detachably inserted into the spring means, and (b) an enlarged front view showing a principal part of a metal plate bending device according to a modified embodiment (Embodiment 6) in a standby condition, wherein the movable plates in Embodiment 2 are detachably inserted into the spring means.
Figure 9:
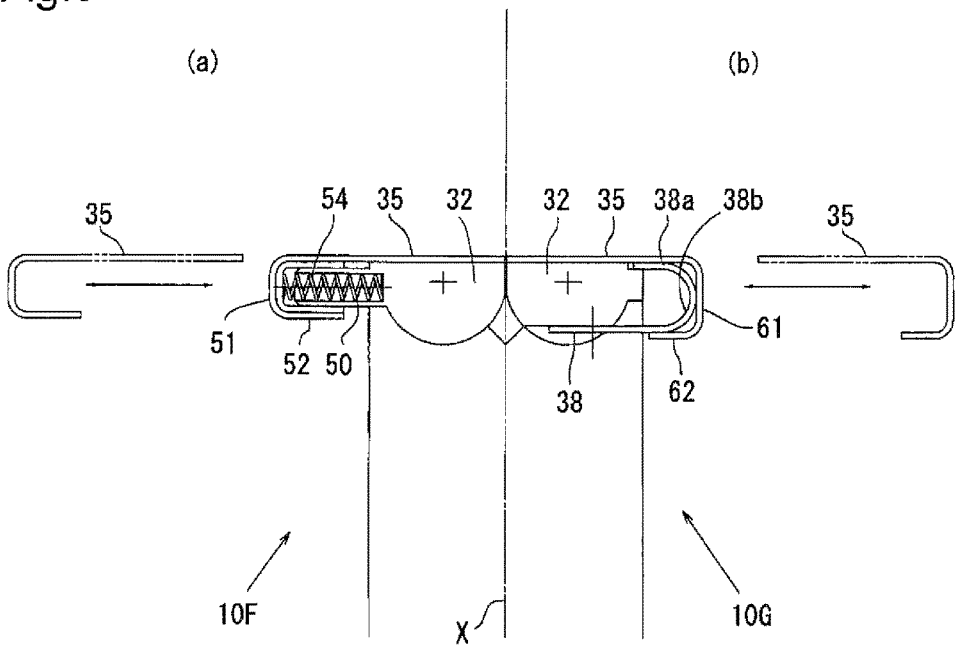
FIG. 9 comprises (a) an enlarged front view showing a principal part of a metal plate bending device according to a modified embodiment (Embodiment 7) in a standby condition, wherein the movable plates in Embodiment 3 are detachably inserted into the spring means, and (b) an enlarged front view showing a principal part of a metal plate bending device according to a modified embodiment (Embodiment 8) in a standby condition, wherein the movable plates in Embodiment 4 are detachably inserted into the spring means.

The metal plate bending devices 10, 10A, 10B, 10C according to the above-described embodiments are all designed such that the movable plate 35, capable of sliding along the upper surface of the swingable member 32 along with expansion of the metal plate W during its bending operation, is included as an element of the spring means (the coil spring 45, the downward flap 49, the coil spring 54, the round portion 55) itself. However, the movable plate 35 may be another member different and separate from the spring means, which is detachably connected to the spring means. Such embodiments are shown in FIG. 8 and FIG. 9. More specifically, FIG. 8(*a*) shows Embodiment 5 that is an embodiment modified from Embodiment 1 by using detachable movable plates 35, FIG. 8(*b*) shows Embodiment 6 that is an embodiment modified from Embodiment 2 by using detachable movable plates 35, FIG. 9(*a*) shows Embodiment 7 that is an embodiment modified from Embodiment 3 by using detachable movable plates 35, and FIG. 8(*b*) shows Embodiment 8 that is an embodiment modified from Embodiment 4 by using detachable movable plates 35. In FIG. 8, Embodiment 5 is shown at one side of the center axis X and Embodiment 6 is shown at another side. Similarly, in FIG. 9, Embodiment 7 is shown at one side of the center axis X and Embodiment 8 is shown at another side. However, as clearly understood by a man skilled in the art, the actual device according to Embodiment 5 is designed symmetrically with respect to the center axis X and has the same structure also at the right side as that shown in FIG. 8(*a*), the actual device according to Embodiment 6 is designed symmetrically with respect to the center axis X and has the same structure also at the left side as that shown in FIG. 8(*b*), the actual device according to Embodiment 7 is designed symmetrically with respect to the center axis X and has the same structure also at the right side as that shown in FIG. 9(*a*), and the actual device according to Embodiment 8 is designed symmetrically with respect to the center axis X and has the same structure also at the left side as that shown in FIG. 9(*b*).

A detailed explanation will be given in reference to FIG. 8*a*. The metal plate bending device 10D according to Embodiment 5 has substantially the same structure as the metal plate bending device 10 according to Embodiment 1, but a connecting plate 56 is interposed between a head 42 of a fastener 41 secured to a hand-down piece 40 of a stationary plate 38 and a coil spring 42, and a leading end portion of a hang-down piece 36 of a movable plate 35 having a size shorter than in Embodiment 1 is detachably inserted into a hang-down piece insertion groove 57 formed at an upper end of the connecting plate 56. In FIG. 8(*a*), the movable plate 35 that has been removed from the bending device 10D is shown above the device in dashed lines. In the illustrated embodiment, the connecting plate 56 comprises three plates layers 56*a*-56*c*, wherein the opposite outer plates 56*a*, 56*c* extends to close to the upper surface of the movable plate 35 (the metal plate supporting surface), whereas the upper extension of the center plate 56*b* is shorter than those, thereby forming the hang-down piece insertion groove 57 having width corresponding to the thickness of the center plate 56*b*. Therefore, the thickness of the center plate 56*b* should be substantially equal to the hang-down piece 36 of the movable plate 35. When using the metal plate bending device 10D according to Embodiment 5, in the same manner as in Example 1, it is possible to bend the metal plate W without formation of no scratches and damages thereon.

Use of the metal plate bending device 10D according to Embodiment 5 will provide an additional advantage. More specifically, when the device is so designed that the shaft 43 of the fastener 41 extends through the lower end portion of the hang-down piece 36 of the movable plate 35 as in Embodiment 1, it is absolutely necessary that the movable plate 35 is shorter than the device. The metal plate W to be subjected to the bending operation has various length. If the device should be too long, it would be difficult to secure uniform accuracy over the entire length, and it would also be impractical in view of costs. Accordingly, in a practical prior art solution for bending a metal plate W having a length exceeding the length of one device, plural devices each having a predetermined length (200-300 mm, for example) are connected to each other in a lengthwise direction, and the metal plate W is mounted over the plural devices. However, when the long-length metal plate W is bent in such a manner, there exists a laterally extending joint or seam between the movable plates 35 of one device and the movable plates 35 of an adjacent device, which could sometimes result in a damage or mark to be formed on the metal plate W. Such laterally extending damage or mark should appear on the metal plate W at an interval of 200 mm, when the device has 200 mm length, thereby greatly degrading the product value.

Figure 10:
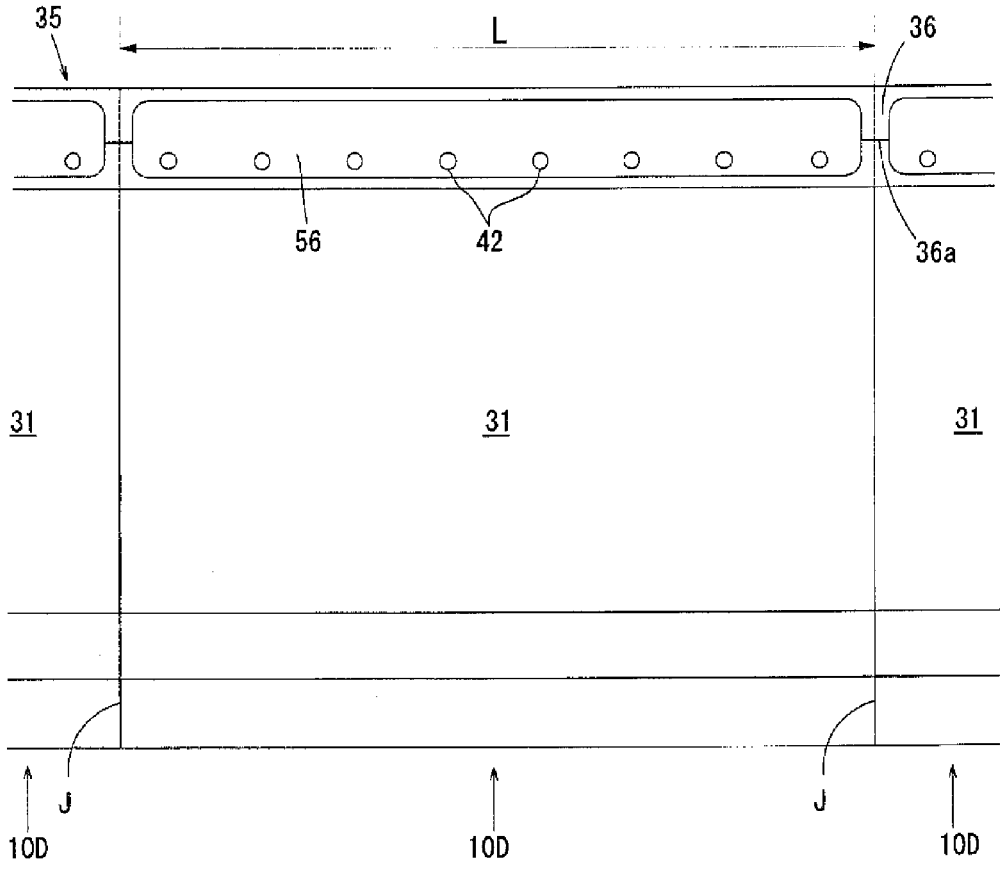
FIG. 10 is a schematic side view showing an embodiment wherein a plurality of the metal plate bending device of Embodiment 5 are connected to each other in a lengthwise direction for bending a long-length metal plate, and long-length movable plates are used to ride successively on the plural metal bending devices.

In contrast, in the metal plate bending device 10D of Embodiment 5, the movable plate 35 is prepared as a separate, detachable member with respect to the spring means and, therefore, may be longer than the total device length L, which will solve the above-described disadvantage by using the movable plate 35 having its length corresponding to the length of the metal plate W to be bent. More specifically, as shown in FIG. 10, when plural (three, for example) bending devices 10D of Embodiment 5 (the total device length L=200 mm, for example) are connected in series is used for bending a long-length 600 mm metal plate W, a 600 mm long movable plate 35 is prepared in advance, and the lower end portion of the hang-down piece 36 of the movable plate 35 is inserted into the hang-down piece insertion groove 57 at the upper end of the connecting plate 56 of each bending device 10D, to be mounted over the three bending devices 10D. The joints J between the adjacent bending devices 10D is hidden by the long-length movable plate 35, so that the bending operation may be performed while preventing the joint-derived damage or mark to be formed on the metal plate W. As such, any metal plate W having various length may be processed with the device. A reference numeral 36*a* in FIG. 10 denotes the lower end portion of the hang-down piece 36 of the movable plate 35.

In addition, the metal plate bending device 10D of Embodiment 5 having the datable movable plate 35 is advantageous in respect to cost, because it is possible to replace the movable plate 35 only, when the movable plate should have been damaged by abrasion relative to the metal plate W after repeated use for bending operation. Moreover, the fact that the movable plate 35 is prepared as an independent member from the spring means (the coil spring 45) will make it easier to design the spring member having an appropriate spring force.

Embodiment 6

The metal plate bending device 10E according to Embodiment 6 shown in FIG. 8(*b*) has substantially the same structure as the metal plate bending device 10A according to Embodiment 2, but differs in that the movable plate 35 is not assembled in advance in the assembly 48 but is arranged detachably. In the illustrated embodiment, a folded plate 58 is superposed on the outside of the hang-down piece 40 of the stationary plate 38, and the leading end of the downward flap 49 of the movable plate 35 is detachably inserted into a gap between a round bar 59 arranged inside of a folded portion of the folded plate and the hang-down piece 40. In FIG. 8(*b*), the movable plate 35 that has been removed from the bending device 10E is shown above the device in dashed lines. In this embodiment as well, the detachable movable plate 35 may be prepared as a long-length detachable plate 35 longer than the entire device length L, so that, as having been described in reference to FIG. 10 in Embodiment 5, by using the long-length movable plate 35 that is longer enough to ride over plural bending devices 10E, the bending operation may be performed while preventing the damage or mark which should otherwise be formed on the metal plate W due to the joint between the adjacent bending devices 10E.

Embodiment 7

The metal plate bending device 10F according to Embodiment 7 shown in FIG. 9(*a*) has substantially the same structure as the metal plate bending device 10B according to Embodiment 3, but differs in that the movable plate 35 is arranged detachably. In FIG. 9(*a*), the movable plate 35 that has been removed from the bending device 10F is shown in left of the device in dashed lines. In the illustrated embodiment, the movable plate 35 is mounted detachably on the swingable member 32 in such manner that the substantially U- or J-shaped movable plate 35 including the hang-down piece 51 and the lower horizontal piece 52 may be fitted from the outside onto the cylinder 50. In this embodiment as well, the detachable movable plate 35 may be prepared as a long-length detachable plate 35 longer than the entire device length L, so that, as having been described in reference to FIG. 10 in Embodiment 5, by using the long-length movable plate 35 that is longer enough to ride over plural bending devices 10F, the bending operation may be performed while preventing the damage or mark which should otherwise be formed on the metal plate W due to the joint between the adjacent bending devices 10F. Although no fastener 53 is used in FIG. 9(*a*), the fastener 53 may be used in the same manner as in Embodiment, so that the position of the movable plate 35 that is restored to the condition of FIG. 9(*a*) by the biasing force by the coil spring 54 when the bending operation is completed may be defined by the head of the fastener 53, which will be deemed as a more preferable embodiment.

Embodiment 8

The metal plate bending device 10G according to Embodiment 8 shown in FIG. 9(*b*) has substantially the same structure as the metal plate bending device 10C according to Embodiment 4, but differs in that the movable plate 35 is arranged detachably. In FIG. 9(*b*), the movable plate 35 that has been removed from the bending device 10F is shown in right of the device in dashed lines. In the illustrated embodiment, a substantially J-shaped stationary plate 38 has an upper horizontal portion 38*a* having a leading end engageable with a recess 60 formed at an upper and outer corner of the swingable member 32 and a curved portion 38*b* formed outwardly of the swingable member 32, which is fixedly connected to the swingable member 32 by the fastener 39 (not shown in FIG. 9(*b*)). A substantially J-shaped movable plate 35 having a hang-down piece 61 and a lower horizontal piece 62 is fitted from the outside onto the stationary plate 38 so that the movable plate 35 is detachably mounted to the swingable member 32 and the stationary plate 38. In this embodiment as well, the detachable movable plate 35 may be prepared as a long-length detachable plate 35 longer than the entire device length L, so that, as having been described in reference to FIG. 10 in Embodiment 5, by using the long-length movable plate 385 that is longer enough to ride over plural bending devices 10G, the bending operation may be performed while preventing the damage or mark which should otherwise be formed on the metal plate W due to the joint between the adjacent bending devices 10G.

LEGENDS

10, 10A, 10B, 10C, 10D, 10E, 10F, 10G metal plate bending device
20 upper die
30 lower die
31 main body of lower die
32 swingable member
33 groove
34 center of rotation of swingable member
35 movable plate
36 hang-down piece of movable plate
37 step
38 stationary plate
39 fastener
40 hang-down piece of stationary plate
41 fastener
42 head of fastener
43 shaft of fastener
44 metal plate supporting surface
45 coir spring (spring means)
46 assembly
47 V-shaped groove
48 assembly
49 downward flap
50 cylinder formed integral with swingable member
51 hang-down piece of movable plate
52 lower horizontal piece of movable plate
53 fastener
54 coil spring (spring means)
55 curved portion (spring means)
56 connecting plate
57 hang-down piece insertion groove
58 folded plate
59 round bar
60 recess at outer/upper corner of swingable member
61 hang-down piece
62 lower horizontal piece
W metal plate

The invention claimed is:

1. A metal plate bending device comprising a lower die having a main body with a pair of semi-circular cross-sectional recesses formed on an upper surface thereof in a symmetric design with respect to a center line and a pair of swingable members swingably received in said recesses respectively, and an upper die arranged above said lower die movably along the center line, wherein said upper die is moved toward a metal plate mounted on said lower die to impart a press-push force to the metal plate to thereby cause the swingable members to swing and at the same time bend the metal plate along the center line, wherein each of said swingable member has a movable plate unfixedly and detachably mounted on a completely flat upper surface of said swingable member, and a spring means for providing a biasing force directly to said movable plate to return said movable plate to a standby condition when the press-push force by said upper die is released, said movable plate providing a completely flat lower surface for slidable, planar contact with the upper surface of said swingable member and providing a completely flat metal plate supporting surface, said movable plate being slidable with respect to said swingable member, and being movable together with said metal plate along with deformation of said metal plate, wherein a plurality of the metal bending devices are connected in series in a lengthwise direction for bending a metal plate longer than a length of a single metal plate bending device, with a selected one of said movable plates equal to or longer than the length of said long-length metal plate, which is mounted successively over said plural metal plate bending devices.

2. The metal plate bending device according to claim 1, wherein said spring means comprises coil spring or leaf spring.

3. The metal plate bending device according to claim 1, wherein said movable plates are directly or indirectly secured by fasteners to said swingable members in the outside of said swingable members, heads of said fasteners positioned externally of said movable plates acting as stopper means for maintaining said swingable members to stay in their starting position.

4. The metal plate bending device according to claim 3, wherein said spring means comprise coil springs surrounding shafts of said fasteners.

* * * * *